US007690892B1

(12) United States Patent
Liang

(10) Patent No.: US 7,690,892 B1
(45) Date of Patent: Apr. 6, 2010

(54) TURBINE AIRFOIL WITH MULTIPLE IMPINGEMENT COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 551 days.

(21) Appl. No.: 11/600,450

(22) Filed: Nov. 16, 2006

(51) Int. Cl.
*F01D 5/18* (2006.01)
*F01D 5/08* (2006.01)

(52) U.S. Cl. ..... 416/1; 416/97 R

(58) Field of Classification Search ..... 415/115; 416/1, 97 R
See application file for complete search history.

(56) References Cited

U.S. PATENT DOCUMENTS

| | | | | |
|---|---|---|---|---|
| 5,246,340 | A | 9/1993 | Winstanley et al. | |
| 6,036,441 | A * | 3/2000 | Manning et al. | 416/97 R |
| 6,183,198 | B1 * | 2/2001 | Manning et al. | 416/97 R |
| 6,206,638 | B1 * | 3/2001 | Glynn et al. | 416/97 R |
| 6,422,817 | B1 * | 7/2002 | Jacala | 416/96 R |
| 6,609,884 | B2 * | 8/2003 | Harvey | 415/115 |
| 6,837,683 | B2 * | 1/2005 | Dailey | 416/97 R |
| 6,955,525 | B2 * | 10/2005 | Liang | 416/97 R |
| 7,097,417 | B2 * | 8/2006 | Liang | 415/115 |
| 7,097,426 | B2 * | 8/2006 | Lee et al. | 416/97 R |
| 7,255,534 | B2 * | 8/2007 | Liang | 416/97 R |
| 7,416,390 | B2 * | 8/2008 | Liang | 416/97 R |
| 2006/0056967 | A1 * | 3/2006 | Liang | 416/97 R |
| 2006/0275119 | A1 * | 12/2006 | Liang | 416/97 R |

* cited by examiner

*Primary Examiner*—Edward Look
*Assistant Examiner*—Sean J Younger
(74) *Attorney, Agent, or Firm*—John Ryznic

(57) ABSTRACT

A turbine blade or airfoil used in a gas turbine engine, the blade having a single cooling air flow path from leading edge to the trailing edge formed from a series of impingement cavities each connected by impingement holes. the series of impingement cavities are formed to alternate from a pressure side cavity to a suction side cavity, and the impingement holes are therefore offset at about 90 degrees, resulting in more impingement cavities being crowded into the length of blade and the impingement holes providing a jet of cooling air directed to a smaller impingement area and at about a head-on direction to the hot section of the cavity. The first impingement cavity is located at the leading edge as is supplied with cooling air from the exterior source, while the last impingement cavity in the series is located in the trailing edge region and includes a plurality of exit holes extending along the trailing edge to discharge the cooling air from the circuit. a greater number of impingement cavities are used in the same length of blade, and a more concentrated impingement jet is directed at the hottest surface of the cavity to provide improved cooling heat transfer coefficient.

8 Claims, 2 Drawing Sheets

TURBINE AIRFOIL WITH MULTIPLE IMPINGEMENT COOLING CIRCUIT

BACKGROUND OF THE INVENTION

1. Field of the Invention

The present invention relates generally to fluid reaction surfaces, and more specifically to a turbine airfoil with a cooling circuits.

2. Description of the Related Art including information disclosed under 37 CFR 1.97 and 1.98

In a gas turbine engine, such as an aero gas turbine or an industrial gas turbine engine, rotor blades and stator vanes in the turbine are cooled by passing compressed air through the airfoils to provide cooling. Air cooled turbine airfoils are required, especially in the first and second stages, in order to allow for an extremely high hot gas flow temperature into the turbine. The higher the hot gas flow temperature entering the turbine, the higher will be the efficiency of the engine.

Since the compressed air used for cooling the turbine airfoils is typically bleed off air from the compressor, it is also desirable to minimize the amount of cooling air used in order to also increase the engine efficiency. Work is performed on the compressed air for cooling by the compressor, and this work is not used to produce power in the engine. Therefore, it is desirable to design an air cooled turbine airfoil that will use a minimal amount of cooling air while providing a maximum amount of cooling to the airfoil in order to increase the efficiency of the engine.

Airfoils of the stator vanes and rotor blades may use similar cooling features, but suitably modified for the different configurations of the vanes and blades, and their different operation since the vanes are stationary, whereas the blades rotate during engine operation and are subject to considerable centrifugal forces. The hollow airfoils of the vanes and blades typically have multiple radially or longitudinally extending cooling channels therein in one or more independent cooling circuits. The channels typically include small ribs or turbulators along the inner surface of the airfoils which trip the cooling air for enhancing heat transfer during the cooling process.

Typical cooling circuits include serpentine circuits wherein the cooling air is channeled successively through the serpentine legs for cooling the different portions of the airfoil prior to discharge therefrom.

The vanes and blades typically include various rows of film cooling holes through the pressure and suction sidewalls thereof which discharge the spent cooling air in corresponding films that provide additional thermal insulation or protection from the hot combustion gases which flow thereover during operation.

Yet another conventional cooling configuration includes separate impingement baffles or inserts disposed inside the nozzle vanes for impingement cooling the inner surface thereof. The baffles include a multitude of small impingement holes which typically direct the cooling air perpendicular to the inner surface of the vane for impingement cooling thereof. The spent impingement cooling air is then discharged from the vane through the various film cooling holes.

Impingement cooling of turbine rotor blades presents the additional problem of centrifugal force as the blades rotate during operation. Accordingly, turbine rotor blades typically do not use separate impingement baffles therein since they are impractical, and presently cannot meet the substantially long life requirements of modern gas turbine engines.

Instead, impingement cooling a turbine rotor blade is typically limited to small regions of the blade such as the leading edge or pressure or suction sidewalls thereof. Impingement cooling is introduced by incorporating a dedicated integral bridge or partition in the airfoil having one or more rows of impingement holes. Turbine rotor blades are typically manufactured by casting, which simultaneously forms the internal cooling circuits and the local impingement cooling channels.

The ability to introduce significant impingement cooling in a turbine rotor blade is a fundamental problem not shared by the nozzle stator vanes. And, impingement cooling results in a significant pressure drop of the cooling air, and therefore requires a corresponding driving pressure between the inside and outside of the airfoils during operation.

Since the pressure distribution of the combustion gases as they flow over the pressure and suction sides of the airfoils varies accordingly, the introduction of impingement cooling in turbine rotor blades must address the different discharge pressure outside the blades relative to a common inlet pressure of the cooling air first received through the blade dovetails in a typical manner.

Some prior art turbine airfoils include film cooling holes connected to a serpentine flow cooling circuit to provide film cooling to the exterior surface of the airfoil. Cooling air discharged out from the airfoil as film cooling air is not used further downstream within the airfoil for cooling. This type of internal serpentine flow and film cooling uses a large amount of cooling air from the compressor. In some situations such as with thin turbine blades, film cooling is not necessary.

Complex cooling circuitry have been proposed in the prior art for stator vanes and rotor blades to provide maximum cooling with a minimal amount of cooling air. Minor changes in the cooling configuration of these components have significant affect on the cooling performance thereof, which significantly affect the efficiency and performance of the gas turbine engine.

U.S. Pat. No. 5,246,340 issued to Winstanley et al on Sep. 21, 1993 and entitled INTERNALLY COOLED AIRFOIL discloses a turbine airfoil in FIG. 5 with a series of impingement cavities extending along the blade, each extending from the pressure side to the suction side wall, and each connected by passages to provide a cooling air flow path through the series of cavities. The disadvantage to the Winstanley invention is that the series of impingement cavities extends along the blade chordwise length in substantially a straight line. The cavities are quite large which results in large impingement areas. Also, multiple impingement holes are used spanning the rib that separates adjacent cavities. In some of the cavities, the impingement hole does not direct the cooling air jet against the hot wall surface of the cavity but directly into the middle of the cavity.

U.S. Pat. No. 6,837,683 B2 issued to Dailey on Jan. 4, 2005 entitled GAS TURBINE ENGINE AIRFOIL discloses a turbine blade or vane with a series of impingement chambers extending along substantially the whole length of the airfoil, where each chamber is connected by to the adjacent chamber by passageways. The chambers in Dailey do not alternate from pressure side to the suction side of the airfoil, but do provide for the long side on either the pressure side or the suction side of which alternates among the adjacent chambers in the series. In the Dailey patent, the impingement cavities are quite large with respect to the blade size, and the rib separating the adjacent cavities includes multiple impingement holes. Like the above Winstanley et al patent, the large cavities result in large impingement areas.

U.S. Pat. No. 7,097,426 B2 issued to Lee et al on Aug. 29, 2006 and entitled CASCADE IMPINGEMENT COOLED AIRFOIL discloses a turbine blade that includes an airfoil having opposite pressure and suction sidewalls joined together at opposite leading and trailing edges and extending longitudinally from root to tip. A plurality of independent cooling circuits is disposed inside the airfoil correspondingly along the pressure and suction sidewalls thereof. Each circuit includes an inlet channel extending through the dovetail. One of the circuits includes multiple longitudinal channels separated by corresponding perforate partitions each including a row of impingement holes for cascade impingement cooling the inner surface of the airfoil. The Lee et al patent uses multiple separate cooling circuits. One impingement circuit is used on the pressure side and a second impingement cooling circuit is used on the suction side. A separate impingement cooling circuit is used for the leading edge showerhead arrangement. The pressure side and suction side impingement cooling circuits are arranged substantially along a straight line from leading edge to trailing edge, resulting in large cavities with large impingements areas. Also, the impingement holes are positioned such that the impingement jet is directed to flow against the hot wall section of the cavity at low angles which results in lower heat transfer coefficient.

In the above cited prior art [patents, the series of impingement cavities result in a short series of impingement cavities with large impingement areas and impingement cooling air jets that are not at the best angle to produce the highest heat transfer coefficient.

Accordingly, it is desired to provide a turbine rotor blade having improved impingement cooling therein. It is another object of the present invention to provide for a greater number of impingement cavities in the series flow through the blade without increasing the length of the blade.

BRIEF SUMMARY OF THE INVENTION

A turbine blade for use in a gas turbine engine in which the internal air cooling circuit includes a cooling air supply channel in the leading edge of the blade and a series of cooling cavities alternating from the suction side to the pressure side in the flow path of the cooling air. The trailing edge includes a plurality of cooling cavities in series with the alternating cavities in which the cooling air is then discharged out through a series of trailing edge exit holes to cool the trailing edge region of the blade. Because the impingement cavities are staggered from pressure side to suction side along the series, the impingement cavities can be made smaller than the prior art and a greater number of impingement cavities can be used in the same size blade. Also, by staggering the impingement cavities this way, the impingement jet is directed substantially at a normal direction to the hot surface of the cavity to increase the heat transfer coefficient. This produces a multiple impingement onto a concave surface at about 90 degrees which yields a higher heat transfer coefficient. More impingement is provided within the cooling circuit path, resulting in greater heat transfer coefficient. All of the cooling air supplied to the leading edge cooling supply channel passes through the series of cooling cavities and is discharged out through the exit holes. the cooling circuit arrangement minimizes the airfoil rotational effects on the internal heat transfer coefficient, is less sensitive to the cooling cavity size, and achieves a very high internal heat transfer coefficient for a given cooling supply pressure level.

DETAILED DESCRIPTION OF THE INVENTION

Figure 1:
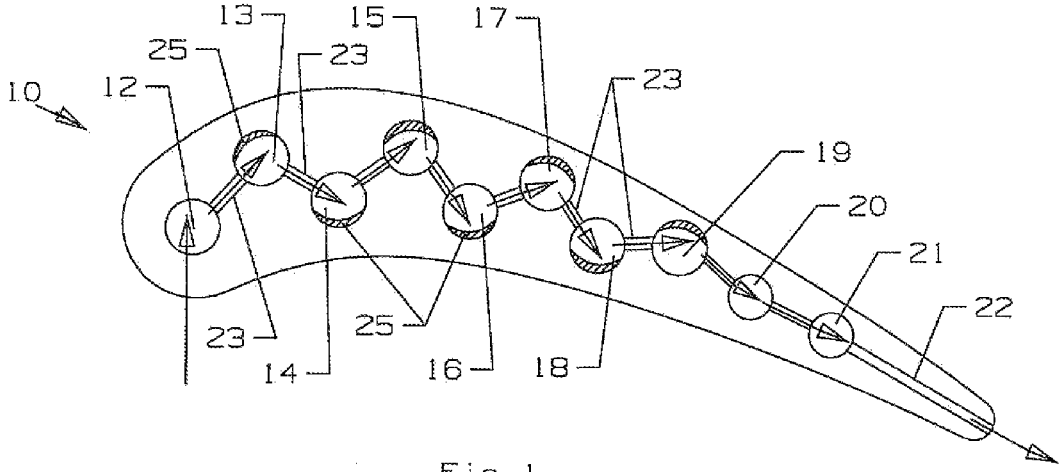
FIG. 1 shows a cross section view of the turbine blade cooling circuit of the present invention.

The present invention is directed to a turbine blade used in a gas turbine engine. However, the concept of the present invention can be used in a stator vane. FIG. 1 shows the turbine blade 10 with the cooling circuit of the present invention. The turbine blade 10 includes a pressure side and a suction side, a leading edge and a trailing edge, with the blade airfoil portion formed between the root and platform and the blade tip. The internal blade cooling circuit includes a leading edge cooling supply channel 12 located in the leading edge region of the blade. The cooling supply channel 12 is supplied with cooling air from an external source through a passage within the blade root as is well known in the prior art. A showerhead cooling arrangement can be incorporated into the cooling supply channel 12 to provide film cooling for the leading edge of the blade.

Figure 2:
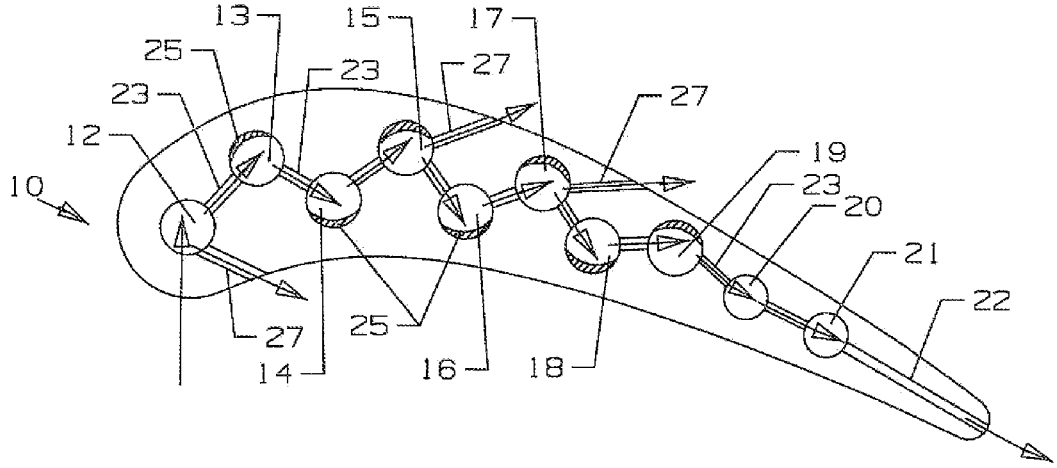
FIG. 2 shows a cross section view of a second embodiment of the present invention in which film cooling holes are included in the series cooling circuit of the first embodiment in FIG. 1.
Figure 3:
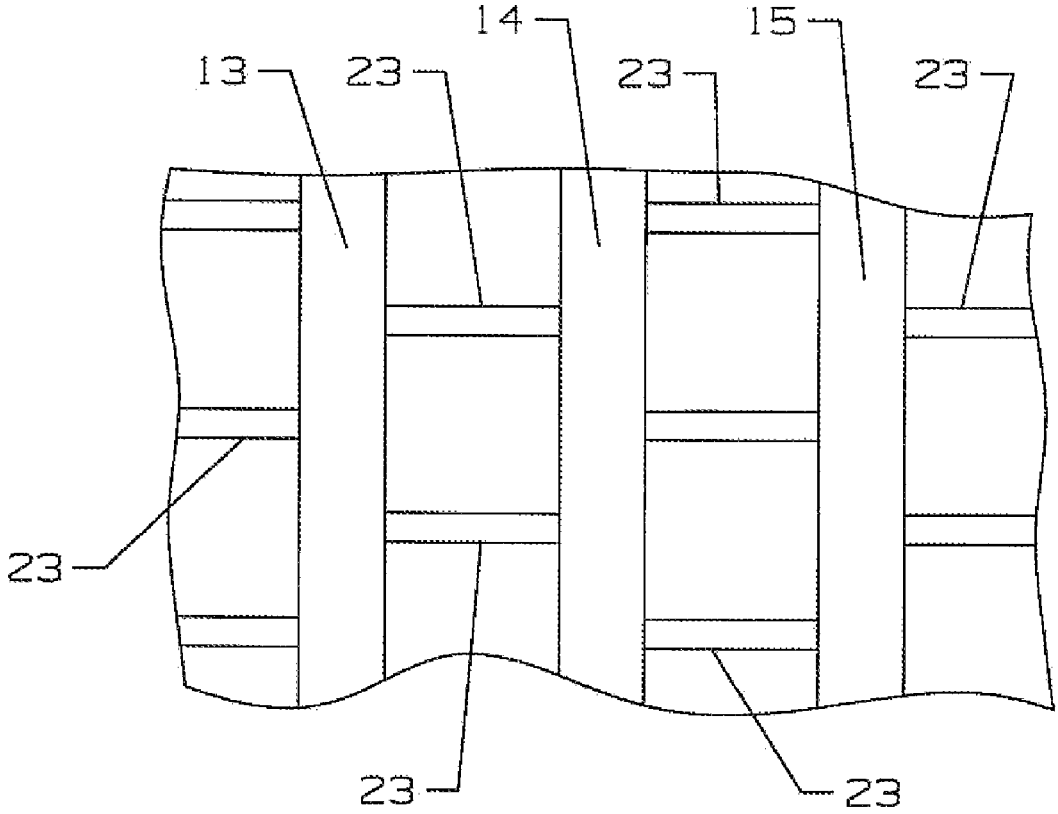
FIG. 3 shows a cross section side view through three of the impingement cavities with inlet and outlet metering holes being offset.

Connected to the cooling supply channel 12 is a series of impingement cavities that alternate from the suction side to the pressure side of the blade until the trailing edge region. In the trailing edge region, the impingement cavities are formed between the two side walls of the blade. A first impingement cavity 13 is connected to the cooling supply channel 12 through a metering and impingement hole 23. The metering holes 23 are staggered along the series at substantially a 90 degree angle as seen in FIGS. 1 and 2. Trip strips 25 are positioned along the hot surface of the impingement cavity 13 to promote turbulence in the cooling air flow and therefore increase the heat transfer coefficient from the blade to the cooling air. The first impingement cavity 13 is shown in the figure located adjacent to the suction side wall of the blade 10. However, the first impingement cavity could be located adjacent to the pressure side of the blade.

A second impingement cavity 14 is connected in series to the first impingement cavity 13 through a metering and impingement hole 23, and whereas the second impingement cavity 14 is located adjacent to the pressure side wall of the blade opposite to the first impingement cavity 13. Thus, the first and second impingement cavities 13 and 14 alternate from pressure side to suction side of the blade. the metering and impingement holes 23 are staggered in order to promote the impingement flow of cooling air within the cavity to swirl as much as possible before passing through the next metering and impingement hole in the series. For example, the metering hole leading into the first cavity 13 is staggered from the metering hole exiting the first cavity 13 so that the cooling air will not flow from the entering the first cavity 13 and straight out the metering hole exiting the first cavity 13 without swirling about the first cavity 13.

The remaining cooling flow path includes a third impingement cavity 15 on the suction side, a fourth impingement cavity 16 on the pressure side, a fifth impingement cavity located on the suction side, and sixth impingement cavity 18 on the pressure side, and a seventh impingement cavity 19 on the suction side, all being connected to each other by impingement and metering holes 23. Each of the impingement cavities 13-19 also includes trip strips 25 on the wall side surface of the cavity to increase the heat transfer coefficient. The remaining impingement cavities 20 and 21 do not alternate from pressure to suction sides of the blade because at this location, the distance between the pressure side and suction side is small and the cavity can provide required cooling to both sides of the blade. Trip strips 25 can be included in these trailing edge region cavities and on both sides of the cavity if required. The last impingement cavity 21 is connected to the trailing edge by trailing edge exit holes that discharge the cooling air out from the trailing edge of the blade and provide for cooling of the trailing edge region. The impingement cavities 13-21 can vary in diameter in order to regulate the pressure and flow velocity of the cooling air in the individual cavities, or can have basically the same diameter along the blade.

The cooling circuit disclosed in FIG. 1 above shows a leading edge cooling supply channel 12 in series with seven alternating impingement cavities and two trailing edge impingement cavities with exit cooling holes 22. However, the number of alternating impingement cavities and the number of trailing edge impingement cavities can vary depending upon the chordwise length of the blade and the length of the trailing edge region. Also, the number of impingement cavities can vary depending upon the diameter of the impingement cavities. By staggering the impingement cavities from the pressure side to the suction side, the impingement cavities can be made smaller and the impingement jet through the impingement and metering holes can be made to strike the hot surface of the cavity at substantially a head-on direction. The metering holes 23 are also staggered at substantially a 90 degree angle as seen in the figures. This allows for the cooling air jet to be directed at a small area of the cavity up against the hottest surface within the cavity and almost directly head-on. The impingement jet can be concentrated onto a smaller area of the hot surface of the cavity resulting in higher heat transfer coefficient. Also, the staggering of the impingement cavities results in a greater number of impingement cavities fitting within the airfoil from the leading edge to the trailing edge. More impingement cavities in the series results in more impingement cooling of the airfoil. This is especially useful in thin airfoils, but is also useful in larger airfoils as well. The staggered impingement cavities in series results in a single cooling flow circuit with a longer flow length than the cited prior art designs. The multiple impingements onto a concave surface at about 90 degrees yield a higher heat transfer coefficient. The cited prior art arrangements provide impingement onto the backside of the airfoil wall at some angle with an impingement jet that is spread out. All of these factors of the cited prior art result in a lower heat transfer coefficient that provided for by the present invention.

The multiple impingement cooling circuit of FIG. 1 makes use of a minimal amount of cooling air to provide cooling for a blade since none of the cooling air is used for film cooling or other cooling that discharges cooling air before reaching the trailing edge. Also, the use of the multiple impingement cavities in series provides higher heat transfer to the cooling air that would a serpentine flow or straight flow through the blade. The cooling air impinges on the hot blade sections while also carrying away heat from regular convection within the cavities.

FIG. 2 shows a second embodiment of the present invention. The FIG. 2 embodiment includes the cooling circuit arrangement of FIG. 1 with the addition of film cooling holes in selective ones of the impingement cavities. The impingement cavities 15 and 17 on the suction side of the blade includes film cooling holes 27 to discharge cooling air onto the suction side wall of the blade, and the cooling supply channel 12 includes a film cooling holes 27 to discharge film cooling air to the pressure side wall of the blade. The film cooling holes are located at impingement cavities near where film cooling on the blade surface is required. In the second embodiment of the present invention of FIG. 2, since the film cooling holes are used, less cooling air reaches the downstream impingement cavities. Because of this effect, the impingement cavities decrease in diameter in order to maintain the desired pressure and flow velocity of the cooling air in order that the maximum heat transfer coefficient will be maintained with the loss of cooling air from film cooling discharge.

In an additional embodiment to the first two described in FIGS. 1 and 2, a separate leading edge cooling air supply channel can be used to supply cooling air to a separate showerhead cooling arrangement. In this embodiment, a separate cooling supply channel would be located adjacent to the showerhead cooling supply channel to supply cooling air to the alternating series of impingement cavities of the present invention.

In both the FIG. 1 and FIG. 2 embodiments, the impingement cavities toward the trailing edge region can be made of smaller diameters in order that the impingement holes 23 will be at about 90 degrees offset from adjacent impingement holes 23, or the impingement cavities can be made less smaller in diameter while providing the impingement holes 23 with greater than 90 degrees offset from adjacent impingement holes along the series. Towards the end of the series of impingement cavities, the impingement holes 23 are about parallel.

I claim the following:

1. An air cooled turbine airfoil comprising:

a leading edge region and a trailing edge region;

a pressure side wall and a suction side wall both extending between the leading edge region and the trailing edge region;

a radial extending cooling air supply channel formed at the leading edge and connected to a source of cooling air external to the airfoil;

a plurality of first radial extending cooling channels formed along the suction side wall to provide impingement cooling to the suction side wall;

a plurality of second radial extending cooling channels formed along the pressure side wall to provide impingement cooling to the pressure side wall; and, the first and second radial extending cooling channels being connected by metering and impingement holes to form a series of alternating pressure side wall to suction side wall impingement channels from the leading edge region to the trailing edge region.

2. The air cooled turbine airfoil of claim 1, and further comprising:

the first radial extending cooling channels are located closer to the suction side wall of the airfoil than to the pressure side wall; and, the second radial extending cooling channels are located closer to the pressure side wall of the airfoil than to the suction side wall.

3. The air cooled turbine airfoil of claim 1, and further comprising:

the first and second radial extending cooling channels are circular in cross section shape.

4. The air cooled turbine airfoil of claim 1, and further comprising:

the trailing edge region of the airfoil includes two radial extending cooling channels located midway between the pressure side wall and the suction side wall and are connected to the first and second radial extending cooling channels in series; and, a row of trailing edge exit holes connected to the last of the two radial extending cooling channels.

5. The air cooled turbine airfoil of claim 4, and further comprising:

the two radial extending cooling channels located in the trailing edge region have a smaller cross section area than the first and second radial extending cooling channels.

6. The air cooled turbine airfoil of claim 1, and further comprising:

the metering and impingement holes are offset in a radial direction of the airfoil so that adjacent radial cooling channels do not have metering and impingement holes that are aligned in the radial direction.

7. The air cooled turbine airfoil of claim 4, and further comprising:

the series of radial extending cooling channels extending from the leading edge radial extending cooling supply channel to the row of trailing edge exit holes form a single cooling flow circuit through the airfoil.

8. The air cooled turbine airfoil of claim 1, and further comprising:

the metering and impingement holes are directed to discharge cooling air against a backside wall of the airfoil wall to provide impingement cooling for the airfoil wall.

* * * * *